US005786087A

United States Patent [19]

Cansler

[11] Patent Number: 5,786,087

[45] Date of Patent: Jul. 28, 1998

[54] HONEYCOMB BRUSH BRISTLES AND BRUSH MADE THEREFROM

[75] Inventor: Ronald B. Cansler, Davidsonville, Md.

[73] Assignee: Specialty Filaments, Inc., Wilmington, Del.

[21] Appl. No.: 392,228

[22] Filed: Feb. 22, 1995

[51] Int. Cl.[6] ..... D02G 3/00; A46B 11/00

[52] U.S. Cl. ..... 428/398; 428/364; 428/394; 428/395; 428/397; 428/399; 15/159.1; 15/207.2

[58] Field of Search ..... 428/364, 395, 428/397, 398, 399; 15/159.1, 207.2

[56] References Cited

U.S. PATENT DOCUMENTS

| | | | |
|---|---|---|---|
| 2,149,425 | 3/1939 | Draemann | 18/54 |
| 2,418,492 | 4/1947 | Alfthan et al. | 18/8 |
| 2,433,325 | 12/1947 | Slaughter | 15/159 |
| 2,476,293 | 7/1949 | Hall et al. | 28/82 |
| 2,637,893 | 5/1953 | Shaw | 28/82 |
| 2,697,009 | 12/1954 | Ingraito | 300/2 |
| 2,907,096 | 10/1959 | Halbig | 28/82 |
| 2,911,761 | 11/1959 | Anderson | 51/80 |
| 3,121,040 | 2/1964 | Shaw et al. | 161/77 |
| 3,184,822 | 5/1965 | Shaw | 28/72 |
| 3,186,018 | 6/1965 | Shaw | 28/72 |
| 3,313,000 | 4/1967 | Hays | 18/8 |
| 3,344,457 | 10/1967 | Grobert | 15/159 |
| 3,402,416 | 9/1968 | Shaw et al. | 15/159 |
| 3,706,111 | 12/1972 | Curtain et al. | 428/397 |
| 3,745,061 | 7/1973 | Champaneria et al. | 428/398 |
| 4,020,229 | 4/1977 | Cox Jr. | 428/398 |
| 4,279,053 | 7/1981 | Payne et al. | 428/398 |
| 4,285,892 | 8/1981 | Betsuda et al. | 264/23 |
| 4,307,478 | 12/1981 | Ward et al. | 428/398 |
| 4,381,325 | 4/1983 | Masuda et al. | 428/397 |
| 4,559,268 | 12/1985 | Nakashima et al. | 428/398 |
| 4,733,425 | 3/1988 | Hartel et al. | 15/206 |
| 4,861,661 | 8/1989 | Samuelson | 428/398 |
| 4,927,281 | 5/1990 | Gueret | 15/159 A |
| 4,937,141 | 6/1990 | Burns | 428/398 |
| 5,032,456 | 7/1991 | O'Brien et al. | 428/398 |
| 5,104,725 | 4/1992 | Broaddus | 428/398 |
| 5,128,208 | 7/1992 | Bond et al. | 428/397 |
| 5,161,554 | 11/1992 | Fitjer | 132/218 |
| 5,190,821 | 3/1993 | Goodall et al. | 428/398 |
| 5,230,957 | 7/1993 | Lin | 428/398 |
| 5,244,704 | 9/1993 | Arima | 428/399 |
| 5,279,897 | 1/1994 | Goodall et al. | 428/398 |
| 5,357,647 | 10/1994 | Gueret | 15/159.1 |
| 5,362,563 | 11/1994 | Lin | 428/398 |

*Primary Examiner*—Patrick Ryan
*Assistant Examiner*—J. M. Gray
*Attorney, Agent, or Firm*—Caesar, Rivise, Bernstein, Cohen, & Pokotilow, Ltd.

[57] ABSTRACT

A "honeycomb"-like paintbrush bristle, either leveled or tapered, has a consistently circular cross-section and two enclosed, longitudinal, hemi-cylindrical voids separated by a single planar interior web which extends diametrically across the bristles interior. The honeycomb bristle is made by extrusion through a die or spinneret which has two generally E-shaped facing openings, so that the resultant bristle has only two external seams along its length.

17 Claims, 1 Drawing Sheet

HONEYCOMB BRUSH BRISTLES AND BRUSH MADE THEREFROM

FIELD OF INVENTION

The present invention relates to synthetic brush bristles and brushes made therefrom, and more especially hollow thermoplastic paintbrush bristles and paintbrushes made therefrom.

BACKGROUND

Synthetic brush bristles have been made from thermoplastic materials in a variety of cross-sectional shapes, both level (non-tapered) and tapered. Noting FIG. 1A, for example, the Nakashima U.S. Pat. No. 4,559,268 discloses thermoplastic polymer paintbrush bristles 3, said to provide excellent stiffness and cleanability, having a cross-section generally in the form of a figure-8 and having a hollow interior of 20–60% based on the entire cross-sectional area. The background section of this patent mentions that "disadvantageous" synthetic paintbrush bristles, tapered or processed at their ends, are currently available in such cross-sections as circular, elliptic, triangular, Y-shaped, flat, cruciform, modified cruciform, three-leafed, four-leafed, cogwheel-shaped, circularly hollow and porously hollow. The various figure-8 bristles disclosed in this patent do not have an outer circumference which is circular, which constitutes a disadvantage in the manufacture of many types of brushes in general and paintbrushes in particular.

Grobert U.S. Pat. No. 3,344,457 shows synthetic paintbrush bristles of various cross-sections including trilobal and tetralobal or cruciform. These bristles also do not have a circular cross-section, and moreover are not hollow. Also see Shaw et al U.S. Pat. No. 3,121,040 and Shaw U.S. Pat. No. 2,637,893 which further show synthetic brush bristles of a trilobal and cruciform cross-sectional configuration, as well as other shapes. An early patent in this field is Slaughter U.S. Pat. No. 2,433,325 which shows tapered and level paintbrush bristles of varying cross-sections.

A more recent patent in this field is U.S. Pat. No. 4,279,053 in the name of Payne et al (Du Pont) which relates to a tri- or tetra-locular oriented polymeric paintbrush bristle. This tri-locular bristle 5 as shown in FIG. 1B has three longitudinal channels or voids 7 extending the length thereof separated by a Y-shaped internal web 8, with the tetra-locular bristle having four longitudinal voids separated by a cruciform internal web. Neither of these bristles has a circular external cross-section, and both have more than two external longitudinal seams 9 which are areas of weakness along which the bristle can fracture.

Brush bristles which do not have a circular cross-section create handling problems in the manufacture of various types of brushes such as paintbrushes. Some of these problems include a lack of uniformity in the resultant brushes, with portions of the brush having a greater density than other portions, because the bristles do not "pack" uniformly; less ability of the brush making equipment to handle non-circular bristles, which equipment uses rollers, chains and/or belts and wherein the bristles are rolled by such equipment, e.g. the non-circular bristles do not flow well through such equipment; and non-circular bristles have a tendency to be marked by the bristle handling and brush forming equipment, so that unsightly transverse marks sometimes undesirably occur on the resultant brush.

Fitjer U.S. Pat. No. 5,161,554 is directed to a mascara brush in which the bristles are secured between twisted segments of wire to attain uniform distribution of tips while avoiding capillary effects at such tips. To accomplish this objective the bristles, while having round cross-sections, further have diameters which vary along their length so as to provide alternating sections of varying diameter including narrow neck portions and bulbous portions. FIG. 9 of this patent shows a cross-section of a bristle having two enclosed, longitudinal voids separated by a S-shaped interior web.

Shaw U.S. Pat. No. 3,184,822 discloses the manufacture of a spatulated fiber, i.e. one which is flattened or progressively flattened in cross section as shown in FIGS. 6–6D and 7–7C, primarily for the purpose of making a broom. One fiber configuration is circular in cross-section prior to spatulation and comprises two enclosed, longitudinal voids separated by an interior web. FIGS. 28 et seq disclose the manufacture of a paintbrush using spatulated fibers and in which the ends of the fibers proximal to the handle are melted (fused) together. The spatulated fibers so used, even if initially of circular cross-section, are no longer circular after being spatulated and therefore suffer from the deficiencies pointed out above.

A number of fiber cross-sections which are suitable for textile and carpet fibers have been proposed, which cross-sections are fully suitable for those uses but are not suitable for brush bristles, especially paintbrush bristles. For example, non-circular fibers are more bulky, which is advantageous for textile and carpet fibers. Also, certain configurations imparted to monofilaments cause the filaments to curl so that, if the monofilament is cut to bristle length, e.g. one inch to six inches for a paintbrush, opposite ends of the monofilament will not line up parallel to the length of the brush. It will also be understood that brush bristles are generally much greater in thickness than textile and carpet fibers, i.e. they have a much greater denier and cross-sectional area, and variations which are tolerable in textile and carpet fibers (indeed beneficial in some respects such as bulkiness) cannot be tolerated for brush bristles.

SUMMARY OF INVENTION

It is, accordingly, an object of the present invention to overcome deficiencies in the prior art, such as indicated above.

It is another object of the invention to provide improved synthetic thermoplastic brush bristles, especially paintbrush bristles, and improved brushes made therefrom.

It is a further object of the present invention to provide improved brush bristles having a circular cross-section, either in level (i.e. non-tapered) form or tapered form, which are improved as regards conventional circular cross-section brush bristles in that they are stiffer and less likely to collapse; which are better and more easily flagged to provide a better and more dispersed flag population at the free ends thereof with more surface area; and which because of their increased stiffness can be used in smaller diameters which in turn results in increased bristle density and better painting, i.e. better holding and release of paint.

It is yet another object of the present invention to provide brush bristles having a circular cross-section especially for paintbrushes which are improved as regards non-circular cross-section brush bristles in that they are better and more easily handled and processed to make a paintbrush; and which consistently make a more uniform paintbrush as well as one which is less likely to have unsightly transverse marks extending thereacross.

It is yet a further object of the present invention to provide brush bristles having a circular cross-section which are improved over tri- and tetra-locular brush bristles in that they have more fracture resistance because they have only two external longitudinal seams, and which have reduced weight and improved function as well as improved diameter control and uniformity; and which are less expensive.

These and other objects of the present invention are achieved by providing monofilamentary "honeycomb"-like paintbrush bristles, either level or tapered such as in accordance with Ward et al U.S. Pat. No. 4,307,478, the contents of which are hereby incorporated by reference, which bristles have a substantially circular cross-section and which have two enclosed, longitudinal, hemi-cylindrical voids separated by a single planar interior web extending diametrically across the interior of the bristles, and which bristles only have two external seams along their lengths.

A straight bristle of this type has never been successfully provided in the past, insofar as is known. This bristle is stabilized by the internal or interior web only at locations 180° from one another, and it has been previously thought that such a hollow bristle internally supported by a web at only two points spaced 180° apart would not be sufficiently stable and would have a tendency to curl along its length so that its two opposite ends would not align, and therefore such a monofilament would not be satisfactory as a brush bristle of the type where the ends must be in alignment, e.g. a paintbrush bristle. However, it has been surprisingly discovered that the present monofilament is not only fully satisfactory in this regard, but is also superior for the reasons pointed out above.

BRIEF DESCRIPTION OF DRAWINGS

Further objects and the nature and advantages of the present invention will be more apparent from the following detailed description, taken in conjunction with the drawing, wherein.

DETAILED DESCRIPTION OF EMBODIMENTS

Figure 2:
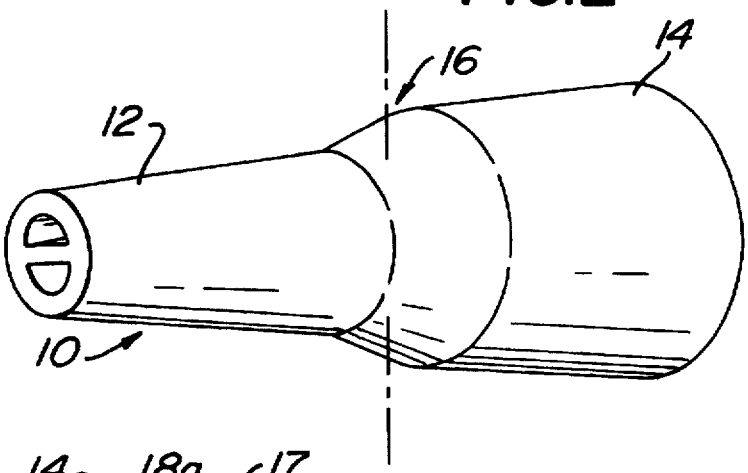
FIG. 2 is an exaggerated, schematic perspective view of a tapered bristle in accordance with the present invention.
Figure 3A:
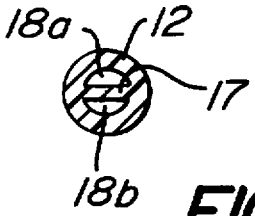
FIGS. 3A and 3B are cross sections of a bristle of FIG. 2 taken, respectively, near the tip end and butt end thereof.
Figure 3B:
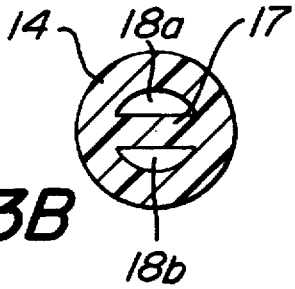

A tapered, hollow brush bristle 10, in accordance with the present invention and as shown in FIG. 2, has a narrow end or tip portion 12 and a large end or butt portion 14, and is continuously tapered from one end to the other, particularly having a central or "neck-down" portion 16 where the slope of the taper is greater than elsewhere along its length, all as explained in the aforementioned Ward et al U.S. Pat. No. '478. In accordance with the present invention, this tapered, hollow bristle 10 is provided with a substantially circular cross-section as can be seen in FIG. 2 as well as FIGS. 3A and 3B, and has two enclosed, longitudinal, hemi-cylindrical voids 18*a* and 18*b* which extend the full length of the bristle and which are separated from one another by a single planar interior web 17 which extends diametrically across the interior of the bristle 10. In cross-section as seen in FIGS. 3A and 3B, the bristle 10 has an annular portion with a substantially circular outer edge corresponding to the outside wall, and a substantially circular inner edge corresponding to the inside wall of the bristle 10.

Figure 1A:
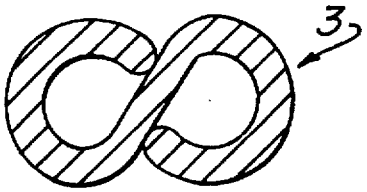
FIG.1A PRIOR ART
FIG. 1A is a cross-section of the figure-8 synthetic bristle of the Nakashima U.S. Pat. No. 4,559,268.
Figure 1B:
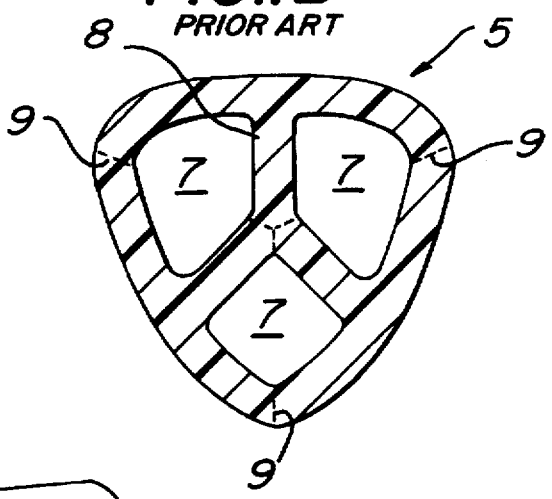
FIG.1B PRIOR ART
FIG. 1B is a cross-section of the tri-locular bristle of the Payne et al U.S. Pat. No. 4,279,053.
Figure 4:
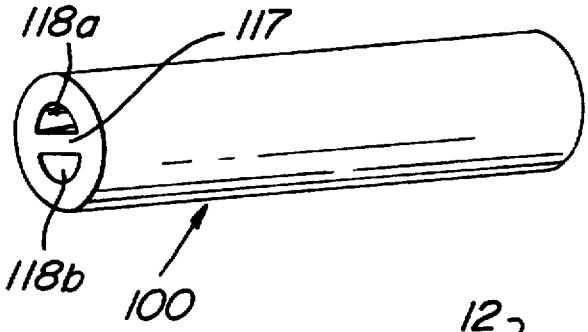
FIG. 4 is an exaggerated, schematic perspective view of a level bristle in accordance with the present invention.

FIG. 4 shows an otherwise similar but level (non-tapered) and generally cylindrical honeycomb bristle 100 also having two enclosed, longitudinal, hemi-cylindrical voids 118*a* and 118*b* separated by a single planar interior web 117 extending diametrically across the interior of the bristle 100.

The honeycomb hollow bristles 10 and 100 of the present invention comprise approximately 15% to 45% hollow volume 18 and 118, and consequently 55% to 85% solid volume, as areas calculated based on the total cross-sectional area. If the monofilament body is made of a non-porous or non-cellular material, it is preferred that the solid portion be no greater than 72%. If the hollow portion is more than 45% (solid portion less than 55%), the strength of the bristle is insufficient and there is a greater likelihood of fracture and/or collapse.

If used in the manufacture of a paintbrush 20, the bristles 10 and 100 of the present invention are suitably of any selected length from about one inch to about six inches, depending on the desired length of the bristle portion of the resultant paintbrush 20. For other types of brushes, other lengths may be desirable. In general, the honeycomb hollow bristles 10 and 100 according to the present invention have an outer diameter of 2–20 mils. In the case of the tapered hollow honeycomb bristle 10, the minimum outer diameter at the tip portion 12 should be no less than about 4 mils, whereas the maximum diameter at the butt portion 14 should be no greater than about 20 mils.

The hollow honeycomb paintbrush bristles 10 and 100 of the present invention may be formed of any of a variety of polymers, including polyesters, polyamides (nylons), polyolefins and blends of such polymers. Preferred materials are nylons and polyesters, most especially polybutylene terephthalate and nylon 6,12.

Figure 6:
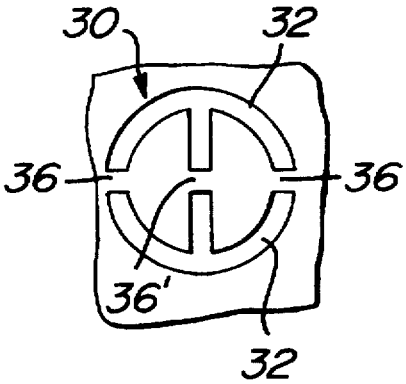
FIG. 6 is a bottom plan view greatly exaggerated in size, of a spinneret opening used to make bristles according to FIGS. 2 and 4, in accordance with the present invention.

The shape of the spinneret opening 30 through which the bristles 10 and 100 of the present invention are extruded or spun is shown in FIG. 6, and is seen to comprise two roughly hemi-circular, generally E-shaped, facing slots 32 separated by two external "land" portions 36 and one internal land portion 36'. Such a die or spinneret opening 30 is relatively simple and inexpensive to manufacture compared with the complex spinnerets used in the prior art such as shown in the aforementioned Payne et al U.S. Pat. No. 4,279,053. As with the spinneret configuration of the aforementioned Ward et al U.S. Pat. No. 4,307,478, the spinneret 30 of the present invention as shown in FIG. 6 defines an almost fully circular slot having an outer diameter, depending on the size of the hollow bristle desired, in the range of from about 15 to about 100 mils, with the thickness of the slot being from about 5.6 to about 7 mils, and the length of the lands 36 and 36' spacing the openings from one another being from about 4.5 to about 6 mils.

It will be understood that the polymer being extruded or spun through the spinneret openings 30 will initially exist in two halves, which two halves weld together immediately downstream of the spinneret 30. One of the advantages of the present invention over prior art such as that of the Payne U.S. Pat. No. 4,279,053 is that the present die configuration 30 results in only two external seams along the length of the resultant monofilament bristle 10 or 100, these being along the aforementioned weld lines; while it will be understood that these weld lines or seams are lines of weakness, the monofilament bristles 10 and 100 according to the present invention have only two such external weld lines, whereas the tri-locular bristles of Payne et al U.S. Pat. No. '053 have three such external seams, and consequently are therefore more subjected to fracture along such seams than are the honeycomb bristles of the present invention.

The rate of throughput of the polymer through the spinneret opening 30 is dependent on a variety of factors, including the polymer being extruded, the distance of the spinneret plate from the quench bath, the size of the spinneret orifices and the number of such orifices. Spinnerets commonly have from 50 to 800 orifices. Depending on the above factors, the throughput rate on a 1.5 inch extruder will range between the values 15 and 100 lbs/hour.

The equipment used for stretching or drawing the monofilaments leaving the spinnerets 30 to form the level bristle 100 is the same equipment which is traditionally used in the manufacture of level brush bristles. Similarly, the equipment used for stretching and tapering the monofilaments leaving the extruder in order to form the tapered bristle 10 is the same equipment which is traditionally used in the manufacture of tapered brush bristles. In the conventional way, the molten polymer is spun from the spinnerets 30 into a water quench bath at 70°–95° F. located at a distance of 1/8 to 15/16 inch from the face of the spinneret, and the hollow-spun continuous honeycomb monofilaments are pulled from the spinneret to provide the desired and typical degree of draw-down, such draw-down being variable in the case of manufacturing tapered bristles 10 and being at a constant rate to provide level bristles 100. Following the hot draw is an orientation stage during which the monofilaments are further drawn to a draw ratio of 3:1 to 4:1, prior to being annealed and then cut to the desired bristle length.

The following examples will further illustrate the manner in which the present invention can be practiced, it being understood that these examples are merely illustrative and not limitative.

EXAMPLE 1

To make tapered, hollow honeycomb bristles 10 having a butt end diameter of 12 mils and a tip end diameter of 8 mils, a spinneret plate having 150 spinneret apertures as shown in FIG. 6 is provided with the outer diameter of each spinneret 30 being 42 mils and the lands 36 and 36' each having a length between the openings of 6 mils. The spinneret is placed on a 1.5 inch extruder and black polybutylene terephthalate is extruded at a rate of 55 lbs. per hour through the spinnerets and into a water quench bath at 85° F. provided 7/16 inches below the spinneret face. The spun hollow honeycomb monofilaments are drawn from the spinneret face at an average draw rate of 2:1, such as to provide 0 draw at the butt end (1:1) and 3:1 at the tip end; the length of each draw sequence is established to provide, after orientation, a bristle length of 4.75 inches. The resultant monofilaments are then passed to an orientation stage where they are further drawn 3.8:1, after which they are annealed and then cut to length.

EXAMPLE 2

Level hollow honeycomb bristles 100 having a diameter of 9 mils are formed by extruding nylon 6,12 through the same extruder described above in Example 1. The spun hollow monofilaments are drawn from the spinneret face at a consistent draw rate of 2:1, and then passed to an orientation stage where they are further drawn 4:1, and then annealed and cut to a bristle length of 4 inches.

Bristles made according to Examples 1 and 2 are highly uniform, have consistent circular cross-section along their length, and are strong and stiff. These honeycomb bristles are easily flagged at their tip ends so as to make superior paintbrushes. Their circular cross-section enables such honeycomb bristles to be easily handled by the brush making equipment, and the resultant brushes are generally free of defects. The flagged ends have a greater surface area compared with conventional hollow bristles, resulting in better holding and release of paint. Having only two external seams, the honeycomb bristles 10 and 100 do not easily fracture.

Figure 5:
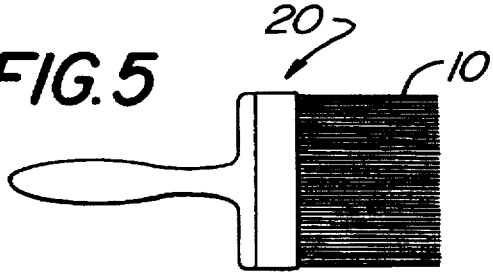
FIG. 5 is a plan view of a paintbrush made using bristles of the present invention.

Brushes of a variety of types can be made using the present bristles 10 and 100. These bristles are particularly suitable for paintbrushes 20 as illustrated in FIG. 5, having a typical handle as shown. It is preferred that 100% of the bristles 10 and/or 100 be used to make such paintbrushes 20, but improved paintbrushes can be made using as little as 15% of such bristles in combination with up to 85% of conventional bristles.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a plurality of monofilamentary brush bristles for association together to form a brush, each bristle being formed of thermoplastic polymeric material having an outer diameter of from 2 to 20 mils, the improvement wherein:

each bristle has a cross section of generally constant shape along its length, the cross section comprising an annular portion bounded by a substantially circular outer edge and a substantially circular inner edge, a single straight interior web portion extending diametrically between opposing portions of the inner edge, the web portion being continuous with the annular portion, and two substantially semi-circular voids enclosed by the web portion and the annular portion and being disposed on opposite sides of the web portion;

the cross-sectional area of the filament having a void content of about from 15% to 45%;

whereby the bristle is generally cylindrical with two hemi-cylindrical voids extending longitudinally therewithin.

2. Brush bristles according to claim 1 wherein the bristles are level.

3. Brush bristles according to claim 1 wherein the bristles are tapered so as to have a large end and a narrow end, and wherein each of the bristles has a minimum outer diameter at said narrow end of about 4 mils and a maximum outer diameter at said large end of about 20 mils.

4. Brush bristles according to claim 1 wherein said thermoplastic polymeric material is selected from the group consisting of polyester and nylon.

5. Brush bristles according to claim 1 wherein the bristles are flagged at one end thereof.

6. Brush bristles according to claim 1, wherein each of the bristles has only two external seams extending longitudinally of said annular portion.

7. Brush bristles according to claim 6, wherein the bristles are flagged at one end thereof, and said thermoplastic polymeric material is selected from the group consisting of polyester and nylon.

8. In a brush comprising a handle and a plurality of bristles extending in length from said handle, the improvement wherein said brush bristles consist of at least 15% of improved bristles;

wherein said improved bristles are each formed of thermoplastic polymeric material and have an outer diameter of from 2 to 20 mils;

each said improved bristle has a cross section of generally constant shape along said length, the cross section comprising an annular portion bounded by a substantially circular outer edge and a substantially circular inner edge, a single substantially straight interior web portion extending diametrically between opposing portions of the inner edge, the web portion being continuous with the annular portion, and two substantially semi-circular voids enclosed by the web portion and the annular portion and being disposed on opposite sides of the web portion;

wherein a void area of the voids is between 15% and 45% of a total cross section area of the cross section.

9. A brush according to claim 8 wherein said bristles are level.

10. A brush according to claim 8 wherein said thermoplastic polymeric material is selected from the group consisting of polyester and nylon.

11. A brush according to claim 8 wherein each of said bristles has only two external seams extending longitudinally of said annular portion.

12. A brush according to claim 11 in the form of a paint brush, wherein at least some of said bristles are flagged at an end thereof, said thermoplastic polymeric material being selected from the group consisting of polyester and nylon.

13. A paint brush according to claim 12, wherein said improved bristles are tapered.

14. A paint brush according to claim 12, wherein said improved bristles are level.

15. A brush according to claim 8 in the form of a paintbrush.

16. A paintbrush according to claim 15 wherein said bristles are tapered.

17. A paintbrush according to claim 15 wherein said bristles are flagged.

* * * * *